United States Patent [19]

Strohbeck et al.

[11] 3,961,774

[45] June 8, 1976

[54] VIBRATORY COMPACTOR

[75] Inventors: Gotthilf Strohbeck, Leonberg; Eugen Stähle, Magstadt, both of Germany

[73] Assignee: Robert Bosch GmbH, Stuttgart, Germany

[22] Filed: Dec. 11, 1974

[21] Appl. No.: 531,617

[30] Foreign Application Priority Data

Jan. 7, 1974 Germany ..... 2400592

[52] U.S. Cl. ..... 259/1 R; 259/DIG. 41

[51] Int. Cl.[2] ..... B01F 11/00

[58] Field of Search..... 259/1 R, DIG. 41, DIG. 42, 259/DIG. 43

[56] References Cited

UNITED STATES PATENTS

| | | | |
|---|---|---|---|
| 2,492,431 | 12/1949 | Kroeckel | 259/DIG. 42 |
| 2,603,459 | 7/1952 | McCrery | 259/DIG. 42 |
| 3,286,991 | 11/1966 | Pellegatti | 259/DIG. 42 |

FOREIGN PATENTS OR APPLICATIONS

| | | | |
|---|---|---|---|
| 1,293,042 | 4/1962 | France | 259/DIG. 42 |
| 360,349 | 3/1962 | Switzerland | 259/DIG. 41 |

*Primary Examiner*—Leonard D. Christian
*Assistant Examiner*—Alan Cantor
*Attorney, Agent, or Firm*—Michael J. Striker

[57] ABSTRACT

A tubular housing of a vibratory compactor has an end portion and vibration-producing structure located within the housing so as to effect vibrating of the housing and thereby of storable concrete or like materials into which the housing is partially or completely immersed. A protective sleeve surrounds the housing over at least part of the axial length thereof so that immersion of this part does not cause ware of the housing but instead causes only ware of the replaceable sleeve. An end cap is mounted on the end portion of the housing and holds the sleeve in place.

11 Claims, 4 Drawing Figures

VIBRATORY COMPACTOR

BACKGROUND OF THE INVENTION

The present invention relates generally to a vibratory compactor, and more particularly to a vibratory compactor of the type that is partly or wholely immersed in flowable concrete or the like to effect compacting of the same.

Vibratory compactors of this type are already known. They usually have a substantially tubular housing having a free end onto which, according to one prior-art construction, a replaceable steel cap is threadedly mounted. This free end with the steel cap is plunged into flowable concrete or other material to be compacted, and an electromotor is energized which effects rotation of an imbalanced mass within the tubular housing. The imbalance of the rotating mass creates vibrations which are transmitted to the housing and from there to the concrete or like material, so that the material thereby becomes compacted. Due to the contact with the substance of the concrete or other material, there is a substantial amount of wear on such compactors. It was assumed that this wear was primarily concentrated at the end cap which, according to the aforementioned prior-art proposal, was made replaceable so that it could be replaced with a new one when it had become excessively worn.

However, it has since been found that the end cap is by no means the only portion of the compactor housing that is subject to very drastic and rapid wear. Instead, the tubular housing itself is also subject to wear, and this wear is particularly strong if the concrete or other material to be compacted contains a large proportion of fine gravel or stone splinters. It has been found that particularly strong wear will occur in the front region of the housing, that is the region which is the leading one when the housing is dipped into the mass to be compacted, in which region the rotating imbalanced mass is mounted in the interior of the housing. Of course, it is self-evidently possible to decrease the wear by decreasing the amount of vibrations that are caused in operation of the device, but on the other hand it is equally evident that this results in a decrease of the operational effectiveness of the device. Another approach would be to replace the housing whenever it becomes worn, but since the housing must be made of expensive highly ware-resistant material to be able to withstand the abrasive effect for a reasonable period of time, this becomes very expensive and in the long run is economically unacceptable.

SUMMARY OF THE INVENTION

It is, accordingly, a general object of this invention to overcome the disadvantages of the prior art.

More particularly, it is an object of the invention to provide an improved vibratory compactor that is not possessed of these disadvantages.

Another object of the invention is to provide such a vibratory compactor wherein the housing can be made of a relatively inexpensive material, for example unhardened steel, but wherein the housing is nevertheless protected in a simple and inexpensive manner against excessive and premature wear.

In keeping with these objects, and with others which will become apparent hereafter, one feature of the invention resides in a vibratory compactor compacting of flowable concrete and the like, which compactor briefly stated comprises a tubular housing having an end portion, vibration-producing means in the housing and operative to cause the same to vibrate so as to effect compacting of concrete or an analogous flowable mass when the housing is dipped thereinto. A protective sleeve surrounds the housing over at least part of the axial length thereof, so that when the housing is dipped into the mass to be compacted it will be the sleeve that is subjected to wear and the housing will be protected by the sleeve. An end cap is mounted on the end portion of the housing and holds the sleeve in place on the housing.

With the construction according to the present invention it is only the sleeve that need be made of highly wear resistant and therefore relatively expensive material, whereas the remainder of the housing is protected against wear by the sleeve and can therefore be made of cheaper material. Moreover, the sleeve requires considerably less material than is required to produce the housing, so that the cost of replacing the sleeve — which can be readily removed and replaced with a new one when the time has come — is much less than if it were necessary to replace the housing per se. The replacement of the sleeve is very simple and rapid and can be carried out even by persons who have no particular skill.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
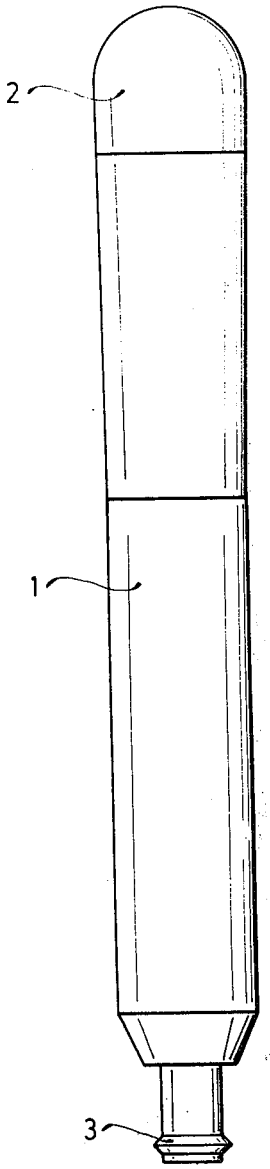
FIG. 1 is a perspective view, on a reduced scale, illustrating a vibratory compactor according to the present invention.
Figure 2:
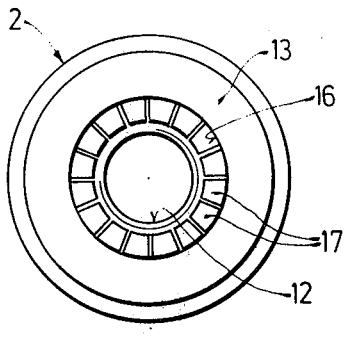
FIG. 2 is a plan view illustrating the end cap of the compactor in FIG. 1.
Figure 3:
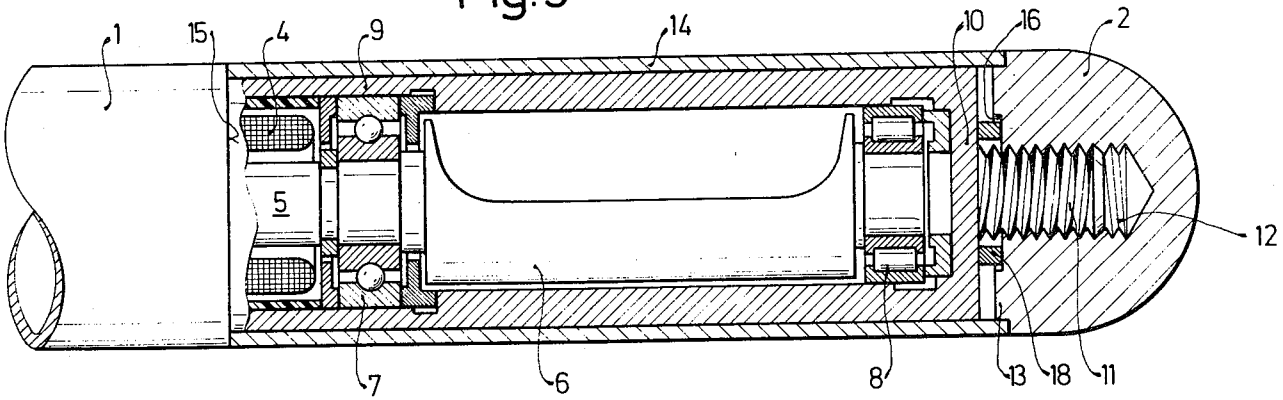
FIG. 3 is a fragmentary axial section through the front end portion of the compactor in FIG. 1.

Referring firstly to the embodiment in FIGS. 1–3 it will be seen that the vibratory compactor illustrated therein has a housing 1 which is of tubular configuration and which is provided at one of its free ends with an end cap 2. At the end of the housing 1 that is remote from the end cap 2 the vibratory compactor has a tube or conduit 3 extending from it (see FIG. 1) through which a not illustrated supply cable extends into the interior of the housing 1, to supply electrical energy to the fragmenttarily illustrated electromotor 4 whose drive shaft 5 is connected with an imbalanced mass 6 which is mounted for rotation in known manner in bearings 7 and 8. Thus, when the mass 6 rotates, its imbalance will create the vibrations which are transmitted via the housing 1 to a surrounding material, such as flowable concrete into which the housing 1 has been dipped, thereby compacting this material.

The front end portion 9 of the housing 1, wherein bearings 7, 8, the mass 6 and a part of the motor 4 are located, has a reduced outer diameter. In the region of the bearing 8 the front end portion 9 of the housing 1 is closed by an end wall 10 which is formed concentrically with an outwardly projecting threaded pin 11 onto which the end cap 2 is threaded which for this purpose is provided with a tapped bore 12. The end cap 2 has a planar end face facing the end wall 10 and formed with a cylindrical projection 13 which extends with slight play into the interior of a protective sleeve 14 which is pushed over the end portion 9. The opposite ends of the sleeve 14 respectively abut the end cap 2 and a shoulder 15 which is formed by the step where the larger outer diameter of the housing 1 is reduced to the smaller outer diameter of the end portion 9. The wall thickness of the sleeve 14 corresponds to the radial width of the shoulder 15; it can be constant over the entire length of the sleeve 14 or it may be variable as will be described subsequently. The sleeve 14 is held in place when the end cap 2 is tightly threaded onto the threaded pin 11 so that the end cap 2 pushes the sleeve against the shoulder 15. The end face of the projection 13 which faces the end wall 10 of the housing 1 is formed with a cylindrical depression 16 the bottom of which is formed with ratchet portions or engaging portions 17 which are here configurated as mutually inclined segments of circles. The upwardly bent end of a spring washer 18 that is received in the depression 16 extends into one of these segments when the spring washer 18 is almost fully compressed in response to tight threading of the end cap 2 onto the pin 11, so that the end cap 2 is thereby prevented from undesired unthreading in response to vibrations transmitted to it.

The sleeve 14 and the end cap 2 are of a material that is highly resistant to wear, for example hardened steel. In the event that the end cap 2 should be of a softer material, such as for example unhardened steel, the arrangement 17 can be omitted since the free end of the spring washer 18 which is of course of very hard material, will then dig into the softer material of the end cap. The sleeve 14 protects the housing 1, so that the entire housing 1, including the front portion 9 thereof, can be of a material that need not have the wear resistance of the sleeve 14 and therefore is less expensive.

As indicated before, vibratory compactors of the type here in question are used to compact flowable concrete and other materials. For this purpose they are dipped into the material, for example concrete, and the vibrations resulting from rotation of the imbalanced mass 6 are transmitted to the concrete or other material to effect compacting of the latter. It is evident that in many instances, for example if crushed or split stones are used as the aggregate in the concrete, which have very sharp edges, the wear to which the compactor will be subjected is very high. By utilizing the end cap 2 and the protective sleeve 4, it will only be these parts that are subjected to such wear whereas the remainder of the housing is protected by them. This means that the housing can be made of relatively cheap material because it need not be so wear resistant, and the sleeve and possibly also the end cap can be replaced much more readily, both from an economic point of view (since lesser quantities of wear resistant material are involved than if the whole housing would have to be replaced) and also because the detaching of the sleeve and the reattachment of a new one is very simple and quick. It is merely necessary to unthread the end cap 2 and withdraw the sleeve 14. It is advantageous if the end cap is renewed whenever the sleeve is renewed, because otherwise the diameters of the two parts will no longer be the same due to the wear of the old end cap whereas the sleeve that has been newly added has not yet so worn.

Figure 4:
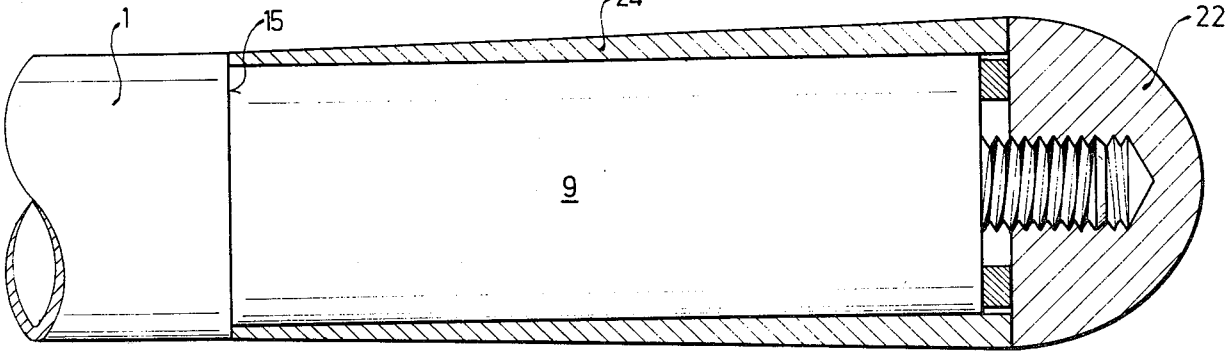
FIG. 4 is a view similar to FIG. 3, but illustrating a further embodiment of the invention and with only parts shown in section.

FIG. 4 shows a further embodiment of the invention wherein the sleeve is identified with reference numeral 24 and its wall thickness increases in the direction towards the end cap 22. The wall thickness at the left-hand free end of the sleeve 24 corresponds again to the radial thickness of the shoulder 15. The purpose of having the wall thickness increase in the direction towards the end cap 22 is to provide more material in the region where wear has been found to be particularly strong.

Figure 5:
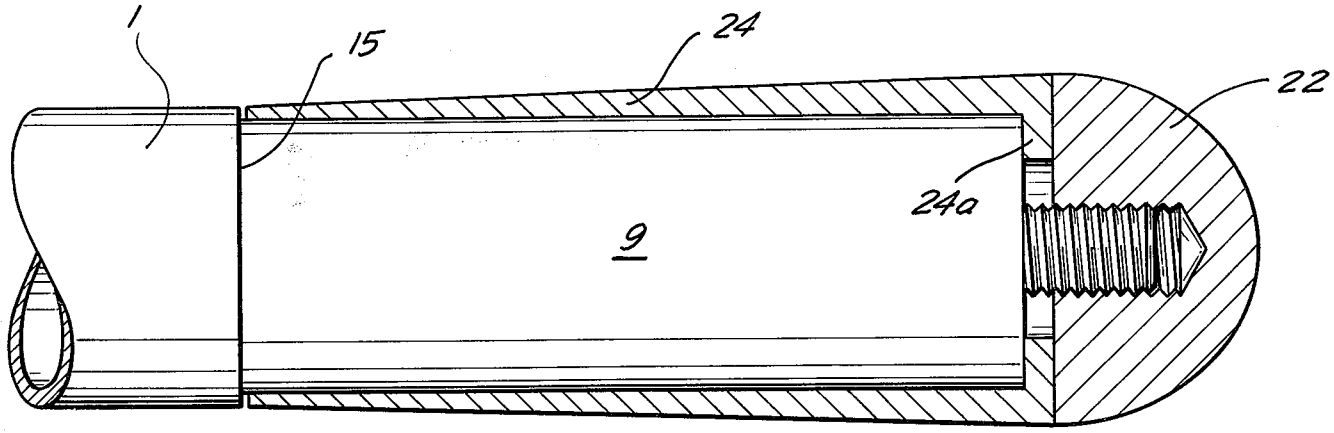
FIG. 5 is a view similar to FIG. 4, but illustrating a further embodiment of the invention.

FIG. 5 shows a further embodiment of the invention wherein a radially inwardly projecting flange **24*a* is carried by the sleeve 24 at the end which abuts the end cap 22. The end cap 22 urges the flange 24*a*** against the axial end wall of the housing.

It is advantageous if the sleeves are made of commercially available steel tubing, because this is a particularly economical way of manufacturing them.

It will be evident that various modifications may be made without departing from the inventive intent. For example, it is clear that the entire construction of the compactor, for example, the manner in which the imbalanced mass 6 is mounted and rotated, or its configuration itself, can be varied without influencing the concept of the invention. It is also possible to provide the front end of the sleeve 14 with a flange-like inwardly or outwardly extending portion which is pressed by the end cap 2 against the end wall 10 of the housing 1. In this case the shoulder 15 could be omitted since the sleeve would be properly held in place without any need for the shoulder 15. The end cap 2 and the sleeve 14 could also be made of one piece with one another, or they could be made integral in the sense that they might be manufactured of two pieces and then welded or otherwise secured to one another to be attachable and detachable as a unit.

It will be understood that each of the elements described above, or two or more together, may also find a useful application in other types of constructions differing from the types described above.

While the invention has been illustrated and described as embodied in a vibratory compactor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims.

1. A vibratory compactor for compacting of flowable concrete and the like, comprising a tubular housing provided with an end portion having an axial end; vibration-producing means in said housing and operative to cause the same to vibrate so as to effect compacting of concrete or an analogous flowable mass when said housing is dipped thereinto; a protective sleeve surrounding said housing over at least part of the axial length thereof, so that when the housing is dipped into the mass to be compacted it will be the sleeve that is subjected to wear and the housing will be protected by the sleeve, said sleeve having a portion axially adjacent said axial end; and an end cap mounted on said end portion and urging said portion of said sleeve against said axial end of said end portion of said housing.

2. A vibratory compactor as defined in claim 1, wherein said sleeve and said end cap are unitary with one another.

3. A vibratory compactor as defined in claim 1, wherein said protective sleeve is of a wear-resistant material.

4. A vibratory compactor as defined in claim 1, wherein said protective sleeve is of hardened steel.

5. A vibratory compactor for compacting of flowable concrete and the like, comprising a tubular housing having an end portion and a shoulder axially spaced from said end portion; vibration-producing means in said housing and operative to cause the same to vibrate so as to effect compacting of concrete or an analogous flowable mass when said housing is dipped thereinto; a protective sleeve surrounding said housing over at least part of the axial length thereof, so that when the housing is dipped into the mass to be compacted it will be the sleeve that is subjected to wear and the housing will be protected by the sleeve; and an end cap mounted on said end portion and holding said sleeve in place on said housing, said sleeve having two axial ends which abut said shoulder and said end cap, respectively.

6. A vibratory compactor as defined in claim 5, said end cap having a surface which faces said end portion axially of said housing and is provided with a projection that is matingly received in said end portion.

7. A vibratory compactor as defined in claim 5, wherein said end portion has a lesser outer diameter than the remainder of said housing, thus forming said shoulder.

8. A vibratory compactor as defined in claim 7, wherein the difference in outer diameters between said end portion and said remainder of said housing corresponds to the wall thickness of said sleeve.

9. A vibratory compactor as defined in claim 7, wherein said sleeve has a wall thickness which increases in direction from said shoulder towards said end cap.

10. A vibratory compactor as defined in claim 7, wherein said sleeve is of substantially uniform wall thickness over its entire length.

11. A vibratory compactor for compacting of flowable concrete and the like, comprising a tubular housing having an end portion provided with an axial end wall; vibration-producing means in said housing and operative to cause the same to vibrate so as to effect compacting of concrete or an analogous flowable mass when said housing is dipped thereinto; a protective sleeve surrounding said housing over at least part of the axial length thereof, so that when the housing is dipped into the mass to be compacted it will be the sleeve that is subjected to wear and the housing will be protected by the sleeve, said sleeve having a radially inwardly projecting flange; and an end cap mounted on said end portion and urging said flange against said axial end wall of said end portion of said housing.

* * * * *